US007575019B2

(12) United States Patent
Oh

(10) Patent No.: US 7,575,019 B2
(45) Date of Patent: Aug. 18, 2009

(54) FAUCET WITH WATER TEMPERATURE RETAINING FEATURE

(76) Inventor: Tae Gon Oh, 545 S. Manhattan Pl. #17, Los Angeles, CA (US) 90020

( * ) Notice: Subject to any disclaimer, the term of this patent is extended or adjusted under 35 U.S.C. 154(b) by 338 days.

(21) Appl. No.: 11/560,303

(22) Filed: Nov. 15, 2006

(65) Prior Publication Data

US 2008/0110502 A1 May 15, 2008

(51) Int. Cl.
*F16K 11/00* (2006.01)

(52) U.S. Cl. ..... 137/454.6; 137/527.8; 137/556.6; 137/597; 137/606; 137/876; 137/887

(58) Field of Classification Search ..... 137/454.6, 137/597, 606, 876, 527, 527.8, 887, 556.6; 251/310

See application file for complete search history.

(56) References Cited

U.S. PATENT DOCUMENTS 508,584 A * 11/1893 Stevens ..... 137/606
4,605,200 A * 8/1986 Huppee ..... 137/606
4,628,962 A * 12/1986 Pezzarossi ..... 137/625.47
4,738,277 A * 4/1988 Thomas ..... 137/454.5
5,487,408 A * 1/1996 Pokhis ..... 137/556.3
5,725,010 A * 3/1998 Marty et al. ..... 137/100
6,626,208 B2 * 9/2003 Chen ..... 137/625.4

* cited by examiner

*Primary Examiner*—Stephen Hepperle
(74) *Attorney, Agent, or Firm*—Lee, Hong, Degerman, Kang & Waimey

(57) ABSTRACT

The present invention is related to a water faucet having a water temperature retaining feature. The water faucet includes a hot water control, a cold water control, a mixing chamber for receiving the hot water and the cold water, a first flow control cartridge operationally coupled with the hot water control for regulating the flow of hot water, a second flow control cartridge operationally coupled with the cold water control for regulating the flow cold water, an outlet for dispensing a mixture of hot and cold water received from the mixing chamber, and a master control for controlling the dispensing of water through the outlet, wherein the master control is capable of stopping the dispensing of water through the outlet while either of the hot water control and the cold water is in an open position.

12 Claims, 8 Drawing Sheets

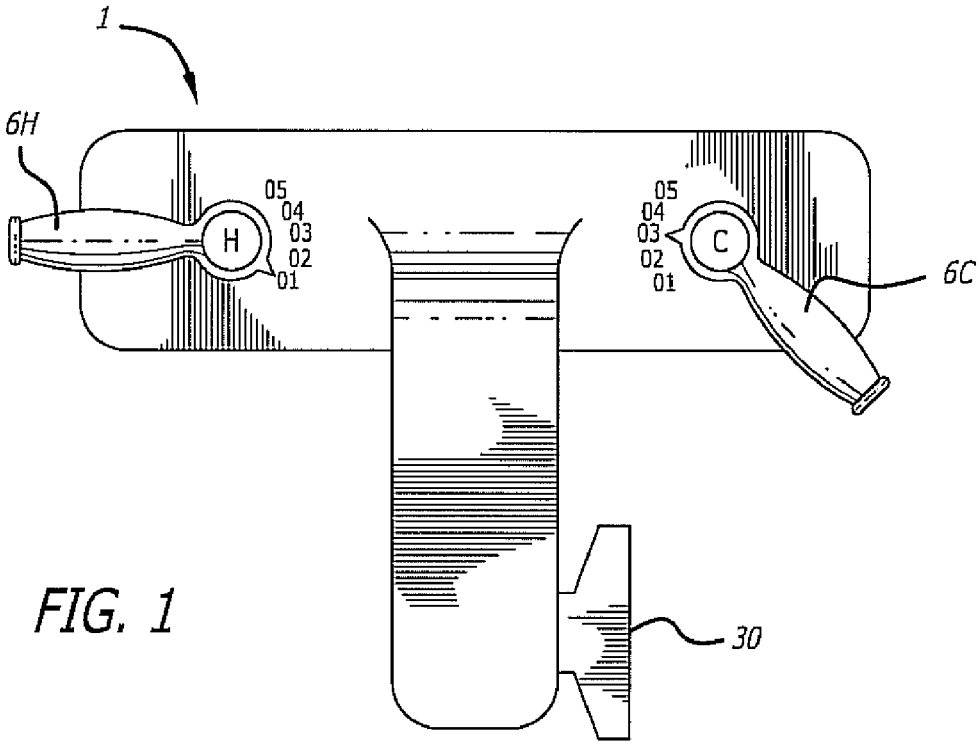
FIG. 1
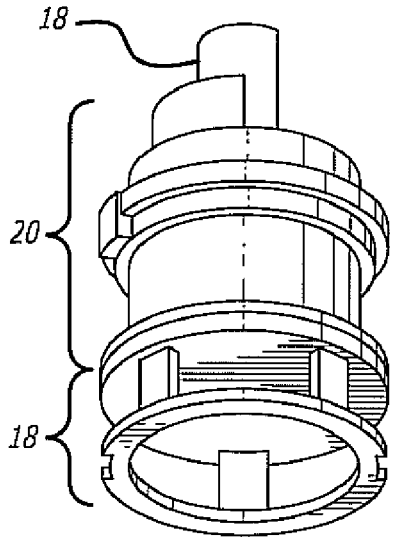
FIG. 3
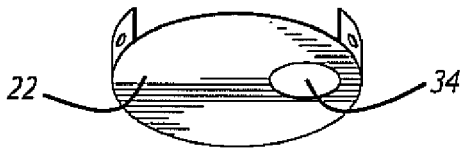

FIG. 8A
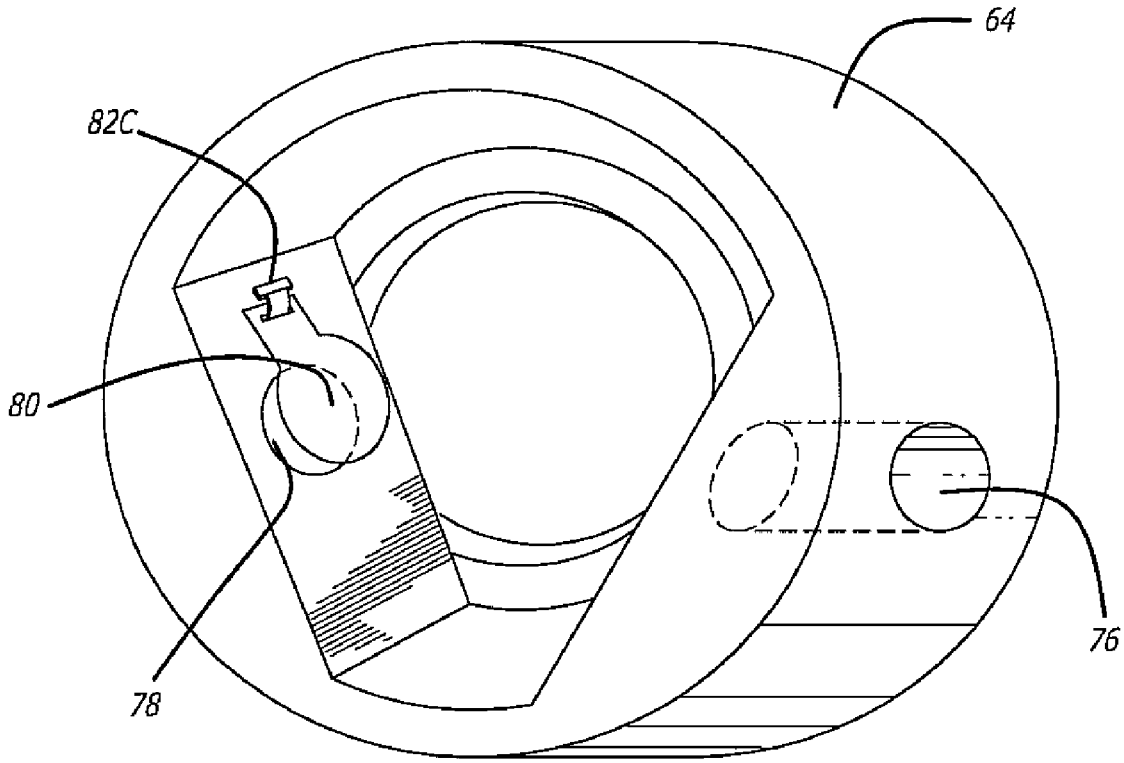
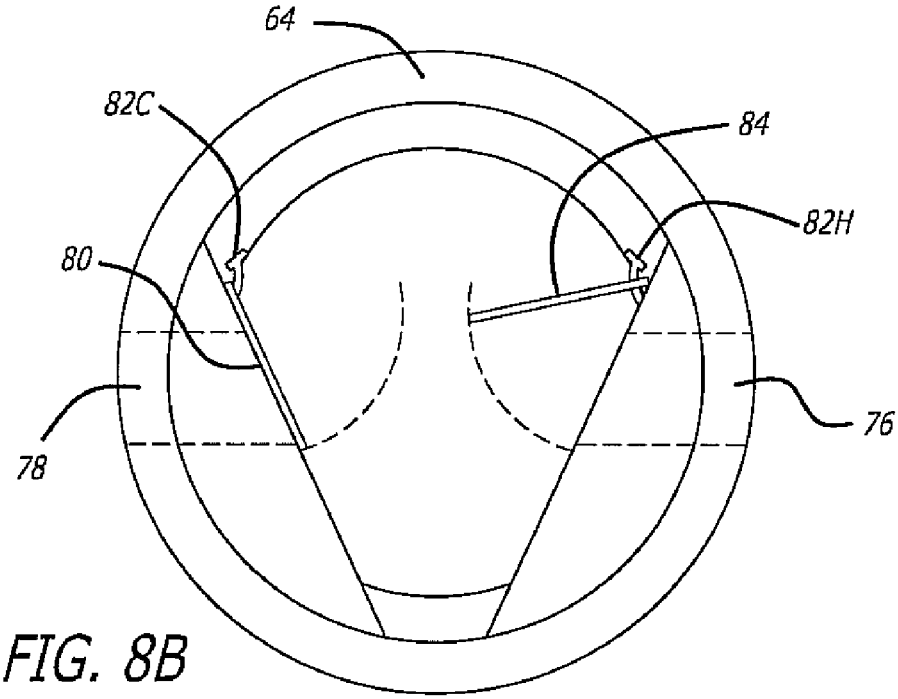
FIG. 8B

FAUCET WITH WATER TEMPERATURE RETAINING FEATURE

FIELD OF THE INVENTION

The present invention relates to a water faucet, and more particularly, to an apparatus for retaining a temperature of water dispensed through the water faucet.

BACKGROUND OF THE INVENTION

Generally, a user utilizing a water faucet is able to manipulate water valves to attain a desired mix of hot and cold water (preferred water temperature) according to the user's preference. However, maintaining the preferred water temperature can be difficult. For example, when taking a shower, a user will turn on a water supply, manipulate the valves, and wait a certain amount of time to achieve the desired mix of hot and cold water. Once the desired mix is achieved, the user will begin to lather his body with soap. However, it is often difficult to lather one's entire body when water is constantly being dispersed from a shower head. To solve this problem, the user will temporarily shut off the flow of water, apply soap to his body, and turn the water faucet on again to rinse off the soap. This process is problematic, however, because the preferred water temperature is lost when the user shuts off the water faucet. Thus, when the user turns the water faucet on again, the user must again manipulate the valves and wait a certain amount of time to reestablish the desired mix of hot and cold water. Unfortunately, when turning the water back on again, the user may be subjected to frigid or scalding water due to the loss of the preferred water temperature. Moreover, the user is inconvenienced because the user must expend additional time to readjust the water temperature.

Additionally, stagnant water within a hot water supply line is typically cold requiring the line to be flushed for a period of time before hot water is delivered. During such lag time, the hot water valve must carefully be manipulated to achieve a desired temperature. Because of this, the user may encounter unwanted water temperature fluctuations while taking a shower, which may subject the user to undesirable water temperatures. Also, the user must wait an additional time for the cold stagnant water in the hot water supply line to heat up to a desired temperature. Accordingly, the user is further inconvenienced.

Furthermore, a significant amount of water is wasted when the user is forced to readjust the water temperature or drain the hot water line of the cold stagnant water. Therefore, there is currently a need for a device that retains a preferred water temperature by maintaining the user's desired mix of hot and cold water even after a water faucet is shut off.

SUMMARY OF THE INVENTION

The present invention is directed to an apparatus for retaining a temperature of water dispensed through a water faucet.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention is embodied in a water faucet having a temperature retaining feature, the water faucet comprising a hot water control for controlling an amount of hot water flowing through the water faucet, wherein the hot water control allows hot water from a hot water supply to flow through the water faucet when the hot water control is in an open position, a cold water control for controlling an amount of cold water flowing through the water faucet, wherein the cold water control allows cold water from a cold water supply to flow through the water faucet when the cold water control is in an open position, a mixing chamber for receiving the hot water from the hot water supply and the cold water from the cold water supply, a first flow control cartridge operationally coupled with the hot water control for regulating the flow of hot water from the hot water supply into the mixing chamber, a second flow control cartridge operationally coupled with the cold water control for regulating the flow cold water from the cold water supply into the mixing chamber, an outlet connected to the mixing chamber for dispensing a mixture of hot and cold water received from the mixing chamber, and a master control for controlling the dispensing of water through the outlet, wherein the master control is capable of stopping the dispensing of water through the outlet while either of the hot water control and the cold water control are in the open position.

Preferably, the water faucet further comprises a hot water pipe for connecting to the hot water supply, a hot water chamber connected between the hot water pipe and the mixing chamber, wherein the hot water chamber houses the first flow control cartridge, a cold water pipe for connecting to the cold water supply, and a cold water chamber connected between the cold water pipe and the mixing chamber, wherein the cold water chamber houses the second flow control cartridge.

In one aspect of the present invention, the first control cartridge comprises an outer cartridge for retaining a fixed position of the first flow control cartridge within the hot water chamber and an inner cartridge rotatably fixed to the hot water control and rotatably coupled to an inner circumference of the outer cartridge, and the second control cartridge comprises an outer cartridge for retaining a fixed position of the second flow control cartridge within the cold water chamber and an inner cartridge rotatably fixed to the cold water control and rotatably coupled to an inner circumference of the outer cartridge.

In another aspect of the present invention, the inner cartridge of the first flow control cartridge comprises a stopper for regulating the flow of hot water from the hot water pipe into the hot water chamber, and the inner cartridge of the second flow control cartridge comprises a stopper for regulating the flow of cold water from the cold water pipe into the cold water chamber.

In a further aspect of the present invention, the stopper of the first flow control cartridge comprises an inlet hole for operating with a chamber hole of the hot water chamber to regulate hot water flow, and the stopper of the second flow control cartridge comprises an inlet hole for operating with a chamber hole of the cold water chamber to regulate cold water flow.

In yet another aspect of the present invention, the amount of hot water flowing into the mixing chamber via the hot water chamber is dependent on a position of the inlet hole of the first flow control cartridge relative to the chamber hole of the hot water chamber, and the amount of cold water flowing into the mixing chamber via the cold water chamber is dependent on a position of the inlet hole of the second flow control cartridge relative to the chamber hole of the cold water chamber.

In yet a further aspect of the present invention, the position of the inlet hole of the first flow control cartridge relative to the chamber hole of the hot water chamber is controlled by the rotational movement of the inner cartridge via the hot water control, and the position of the inlet hole of the second flow control cartridge relative to the chamber hole of the cold water chamber is controlled by the rotational movement of the inner cartridge via the cold water control.

Preferably, the water faucet further comprises a first check valve disposed on the stopper of the first flow control cartridge for movably sealing the inlet hole to prevent backflow of water into the hot water pipe, and a second check valve disposed on the stopper of the second flow control cartridge for movably sealing the inlet hole to prevent backflow of water into the cold water pipe.

Preferably, an exterior of the water faucet comprises markings for use with the hot and cold water controls to respectively measure the amount of hot and cold water capable of flowing through the water faucet.

Preferably, the master control is manipulated to seal the outlet when stopping the dispensing of water through the outlet while either of the hot water control and the cold water control is in the open position.

In accordance with another embodiment of the present invention, a water faucet having a temperature retaining feature comprises a hot water control for controlling an amount of hot water flowing through the water faucet, wherein the hot water control allows hot water from a hot water supply to flow through the water faucet when the hot water control is in an open position, a cold water control for controlling an amount of cold water flowing through the water faucet, wherein the cold water control allows cold water from a cold water supply to flow through the water faucet when the cold water control is in an open position, a flow control cartridge operationally connected to the hot water supply and cold water supply for regulating the flow of hot and cold water into the water faucet, a shower dispenser connected to the flow control cartridge for dispensing a mixture of hot and cold water received via the flow control cartridge, a tub dispenser connected to the flow control cartridge for dispensing a mixture of hot and cold water received via the flow control cartridge, and a master control operationally connected to the flow control cartridge for controlling the dispensing of water through the shower dispenser and the tub dispenser, wherein the master control is capable of stopping the dispensing of water through the shower dispenser and the tub dispenser while either of the hot water control and the cold water control are in the open position.

In one aspect of the invention, the flow control cartridge comprises a base cartridge for receiving hot and cold water, an outer cartridge connected to the base cartridge, wherein the outer cartridge is capable of directing water received via the base cartridge toward the shower dispenser and the tub dispenser, and an inner cartridge rotatably disposed within an inner circumference of the outer cartridge for controlling which of the shower dispenser and the tub dispenser to dispense water through.

Preferably, the base cartridge comprises a hot water inlet for receiving hot water from a hot water supply, and a cold water inlet for receiving cold water from a cold water supply. Preferably, an interior of the base cartridge comprises a mixing chamber for mixing the received hot and cold water.

Preferably, the outer cartridge comprises a shower outlet for directing water toward the shower dispenser, and a tub outlet for directing water toward the tub dispenser.

Preferably, the inner cartridge comprises a diverting outlet for controlling which of the shower dispenser and the tub dispenser to dispense water through, wherein the diverting outlet directs water toward the shower dispenser when rotatably aligned with the shower outlet of the outer cartridge and directs water toward the tub dispenser when rotatably aligned with the tub outlet of the outer cartridge.

In another aspect of the present invention, alignment of the diverting outlet to either of the shower outlet and tub outlet is rotatably controlled by the master control operationally connected to a protruding portion of the inner cartridge. Preferably, the master control stops the dispensing of water through the shower dispenser and the tub dispenser while either of the hot water control and the cold water control is in the open position by rotating the inner cartridge such that the diverting outlet is not aligned with either of the shower outlet and tub outlet.

In a further aspect of the present invention, the water faucet comprises a first check valve disposed on an interior of the base cartridge for movably sealing the hot water inlet hole to prevent backflow of water into the hot water supply, and a second check valve disposed on an interior of the base cartridge for movably sealing the cold water inlet to prevent backflow of water into the cold water supply.

Preferably, an exterior of the water faucet comprises markings for use with the hot and cold water controls to respectively measure the amount of hot and cold water capable of flowing through the water faucet.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

FIG. 1 illustrates a sink faucet having a water temperature retaining feature in accordance with one embodiment of the present invention.

FIG. 3 illustrates a flow control cartridge for use in a sink faucet in accordance with one embodiment of the present invention.

FIG. 8A illustrates a partial perspective view of a flow control cartridge having check valves in accordance with one embodiment of the present invention.

FIG. 8B illustrates a cross-sectional view of a flow control cartridge having check valves in accordance with one embodiment of the present invention.

DETAILED DESCRIPTION OF THE PREFERRED EMBODIMENTS

The present invention relates to an apparatus for retaining a temperature of water dispensed through a water faucet.

Figure 2:
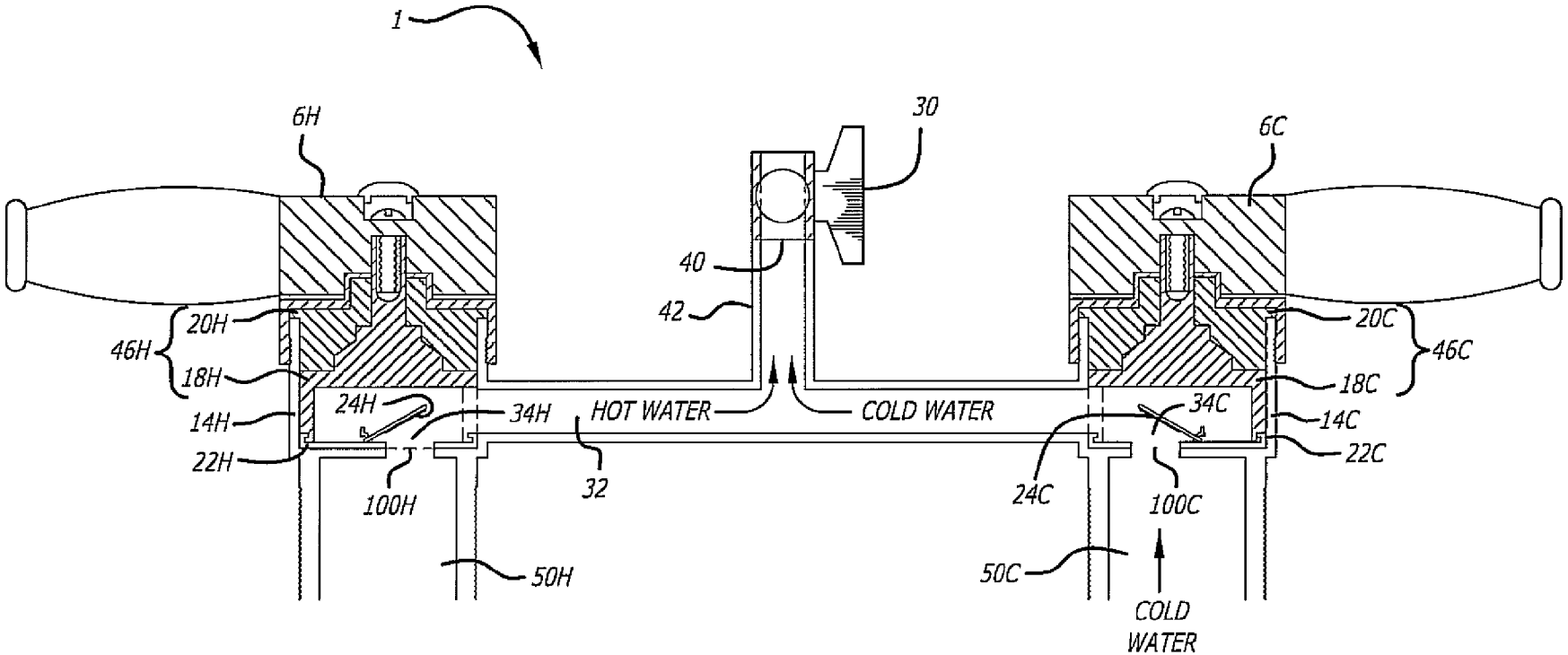
FIG. 2 illustrates an internal structure of a sink faucet having a water temperature retaining feature in accordance with one embodiment of the present invention.

FIG. 1 illustrates a sink faucet having a water temperature retaining feature in accordance with one embodiment of the present invention. FIG. 2 illustrates an internal structure of a sink faucet having a water temperature retaining feature in accordance with one embodiment of the present invention. Referring to FIGS. 1 and 2, the sink faucet 1 comprises a hot water handle 6H for controlling the flow of hot water and a cold water handle 6C for controlling the flow of cold water through the sink faucet 1. When the hot water handle 6H is in a closed position, hot water from a hot water reservoir resides in a hot water pipe 50H. Likewise, when the cold water handle is in a closed position, cold water from a cold water reservoir resides in a cold water pipe 50C. When the hot water handle 6H is manipulated into an open position, the hot water residing in the hot water pipe 50H is allowed to flow into a mixing chamber 32. In the mixing chamber 32, the hot water mixes with the cold water flowing from the cold water pipe 50C when the cold water handle 6C is manipulated into an open position. Preferably, the hot and cold water handles are manipulated by a user such that a preferred mixed water temperature is achieved according to the user's preference. Furthermore, an exterior of the water faucet preferably comprises markings for use with the hot and cold water handles in order for the user to respectively measure the amount of hot and cold water capable of flowing through the water faucet.

After mixing in the mixing chamber 32, the mixed water flows through a water passage 42 to be dispensed through an outlet 40. In accordance with the present invention, the sink faucet 1 further comprises a master handle 30 for controlling the dispensing of mixed water through the outlet 40. Preferably, the master handle 30 is disposed near the outlet 40 and is capable of sealing the outlet 40 to cease the dispensing of water Accordingly, while the hot water handle 6H and the cold water handle 6C remain in the open position, mixed water flow through the outlet 40 may be stopped by manipulating the master handle 30 into a closed position. Thus, when the user achieves the preferred water temperature by successfully manipulating the hot water handle 6H and the cold water handle 6C to achieve a preferred ratio of hot and cold water, the user may use the master handle 30 to shut off water flow without having to close off the hot and cold water handles. This greatly conveniences the user the next time he/she wishes to use the sink faucet 1 because the user does not have to re-manipulate the hot and cold water handles to attain the preferred ratio of hot and cold water. Therefore, by leaving the hot and cold water handles in the position they were in prior to shutting off the master handle 30, the preferred mix of hot and cold water will be duplicated when the master handle 30 is moved to the open position at a later point in time. In addition, the volume of water flow can be adjusted up or down at any time by manipulating the master handle 30 without affecting the preferred ratio of hot and cold water, which was preset by the hot water handle 6H and the cold water handle 6C.

Referring to FIG. 2, a cold water chamber 14C houses a flow control cartridge 46C for regulating the flow of water from the cold water pipe 50C to the mixing chamber 32. As shown, the flow control cartridge 46C comprises an outer cartridge 20C and an inner cartridge 18C. The outer cartridge 20C helps retain a fixed lateral and longitudinal position of the flow control cartridge 46C within the cold water chamber 14C. Meanwhile, the inner cartridge 18C is rotatably coupled to an inner circumference of the outer cartridge 20C such that it can axially rotate relative to the outer cartridge 20C.

An upper portion of the inner cartridge 18C is attached to the cold water handle 6C. Preferably, the upper portion of the inner cartridge 18C is threaded, such that the cold water handle may be screwed down to the inner cartridge 18C. A lower portion of the inner cartridge 18C comprises a stopper 22C for regulating water flow. Preferably the stopper 22C comprises an inlet hole 34C for operating with a chamber hole 100C of the cold water chamber 14C to regulate the flow of cold water from the cold water pipe 50C into the cold water chamber 14C, and eventually into the mixing chamber 32.

In operation, when the cold water handle 6C is turned to the closed position, the inner cartridge 18C, attached to the cold water handle 6C is also turned to the closed position. Accordingly, when the inner cartridge 18C is turned to the closed position, the inlet hole 34C of the stopper 22C is turned away from the chamber hole 100C to prevent cold water from entering into the cold water chamber 14C. However, when the cold water handle 6C is turned to an open position, the inner cartridge 18C consequently turns axially relative to the outer cartridge 20C. Accordingly, the inlet hole 34C of the stopper 22C turns toward the chamber hole 100C to allow cold water to flow through the cold water chamber 14C and into the mixing chamber 32. Preferably, present invention is designed such that the more the cold water handle 6C is turned to the open position, the more the inlet hole 34C is exposed to the chamber hole 100C to allow more cold water to flow into the mixing chamber 32.

Still referring to FIG. 2, a hot water chamber 14H houses a flow control cartridge 46H for regulating the flow of water from the hot water pipe 50H to the mixing chamber 32. As shown, the flow control cartridge 46H comprises an outer cartridge 20H and an inner cartridge 18H. The outer cartridge 20H helps retain a fixed lateral and longitudinal position of the flow control cartridge 46H within the hot water chamber 14H. Meanwhile, the inner cartridge 18H is rotatably coupled to an inner circumference of the outer cartridge 20H such that it can axially rotate relative to the outer cartridge 20H.

An upper portion of the inner cartridge 18H is attached to the hot water handle 6H. Preferably, the upper portion of the inner cartridge 18H is threaded, such that the hot water handle may be screwed down to the inner cartridge 18H. A lower portion of the inner cartridge 18H comprises a stopper 22H for regulating water flow. Preferably, the stopper 22H comprises an inlet hole 34H for operating with a chamber hole 100H of the hot water chamber 14H to regulate the flow of hot water from the hot water pipe 50H into the hot water chamber 14H, and eventually into the mixing chamber 32.

In operation, when the hot water handle 6H is turned to the closed position, the inner cartridge 18H, attached to the hot water handle 6H is also turned to the closed position. Accordingly, when the inner cartridge 18H is turned to the closed position, the inlet hole 34H of the stopper 22H is turned away from the chamber hole 100H to prevent hot water from entering into the hot water chamber 14H. However, when the hot water handle 6H is turned to an open position, the inner cartridge 18H consequently turns axially relative to the outer cartridge 20H. Accordingly, the inlet hole 34H of the stopper 22H turns toward the chamber hole 100H to allow hot water to flow through the hot water chamber 14H and into the mixing chamber 32. Preferably, present invention is designed such that the more the hot water handle 6H is turned to the open position, the more the inlet hole 34H is exposed to the chamber hole 100H to allow more hot water to flow into the mixing chamber 32.

Preferably, the hot and cold water combine in the mixing chamber 32 prior to flowing through the water passage 42 and being dispensed out of the outlet 40. According to a user's preference, the cold water handle 6C and the hot water handle 6H may be manipulated until a preferred ratio of hot and cold water is attained. Once the preferred ratio is achieved, the hot and cold water handles are left in their respective positions. When the user wishes to shut off water flow, the user may manipulate the master handle 30 to cease dispensing of the water. Accordingly, by using the master handle 30 to shut off water flow, the hot water handle 6H and the cold water handle 6C remain in the same respective positions they were in prior to shut off. Thus, when the user wishes to resume water flow at the preferred ratio of hot and cold water, the user may simply turn the master handle 30 to the open position without having to re-manipulate the hot and cold water handles. Also, by manipulating the master handle 30, the volume of water flow can be re-adjusted up or down without affecting the preferred ratio of hot and cold water.

Consequently, by being able to resume water flow without having to re-manipulate the hot and cold water handles, water may be conserved. For example, a maximum volume of water flow can be preset at the same time as the preferred water temperature using the hot and cold water handles. Accordingly, when the master handle 30 is manipulated to resume water flow, only the maximum preset volume of water will flow through the outlet 40. This is advantageous with certain users, such as children, who may irresponsibly manipulate hot and cold water handles of a typical faucet without regard to water conservation, Hence, by utilizing the sink faucet of the present invention, users are able to easily conserve water without undue burden.

Figure 4A:
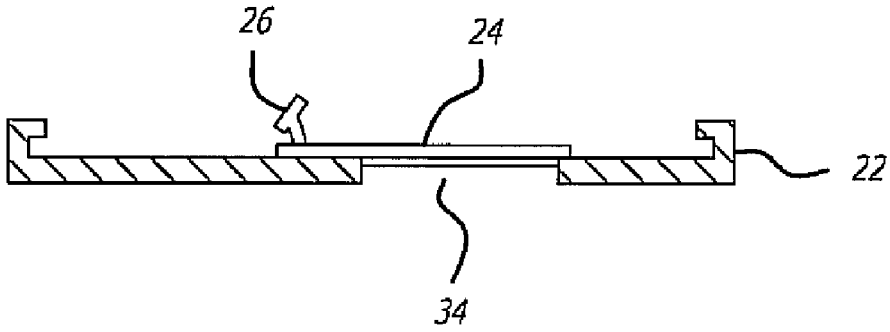
FIG. 4A illustrates a stopper of a flow control cartridge having a check valve in a closed position in accordance with one embodiment of the present invention.
Figure 4B:
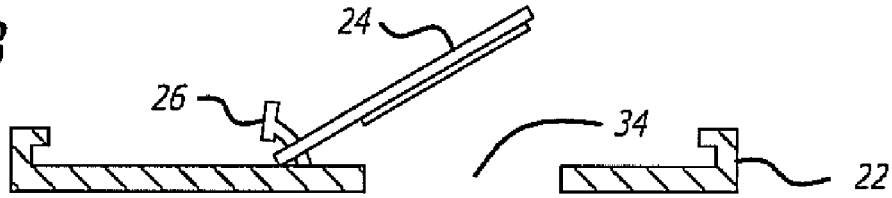
FIG. 4B illustrates a stopper of a flow control cartridge having a check valve in an open position in accordance with one embodiment of the present invention.
Figure 4C:
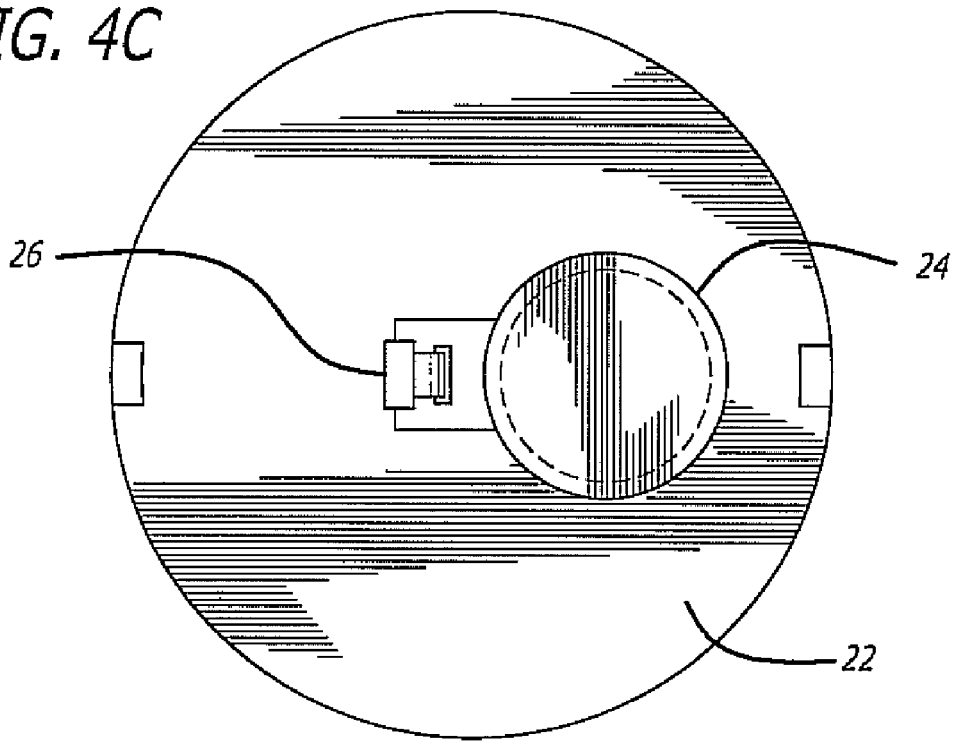
FIG. 4C illustrates a top elevational view of a stopper of a flow control cartridge having a check valve in a closed position in accordance with one embodiment of the present invention.

FIG. 3 illustrates a flow control cartridge for use in a sink faucet in accordance with one embodiment of the present invention. FIGS. 4A-4C illustrate a stopper of a flow control cartridge having a check valve in accordance with one embodiment of the present invention. Referring to FIGS. 2, 3 and 4A-4C, a check valve 24C is disposed on the stopper 22C for movably sealing the inlet hole 34C. Furthermore, a check valve 24H is disposed on the stopper 22H for movably sealing the inlet hole 34H. Preferably, a portion of the check valve 24C is coupled to the stopper 22C via a check valve hook 26C, and a portion of the check valve 24H is coupled to the stopper 22H via a check valve hook 26H. Here, the check valve hooks allow the respective check valves to open and close upon the respective inlet holes 34C and 34H.

In operation, when the cold water handle 6C is turned to the open position, pressure from the cold water flowing from the cold water pipe 50C toward the cold water chamber 14C causes the check valve 24C to lift up at one side, thus allowing the cold water to flow through the cold water chamber 14C and into the mixing chamber 32. Likewise, when the hot water handle 6H is turned to the open position, pressure from the hot water flowing from the hot water pipe 50H toward the hot water chamber 14H causes the check valve 24H to lift up at one side, thus allowing the hot water to flow through the hot water chamber 14H and into the mixing chamber 32.

However, when the user wishes to shut off water flow using the master handle 30 while the hot and cold water handles remain in the open position, a pressure difference between the hot and cold water in the mixing chamber 32 may cause backflow to occur. For instance, if the pressure of hot water in the mixing chamber 32 is greater than the pressure of the cold water, then the water in the mixing chamber 32 will move toward the cold water chamber 14C and back into the cold water pipe 50C. Consequently, if hot water is allowed to enter into the cold water pipe 50C, the water within the cold water pipe 50C will be heated and can no longer be relied upon by the user to be consistently cold. Accordingly, the ability to maintain a preferred water temperature is lost due to the inconsistent temperature of the cold water.

Alternatively, if the pressure of cold water in the mixing chamber 32 is greater than the pressure of the hot water, then the water in the mixing chamber 32 will move toward the hot water chamber 14H and back into the hot water pipe 50H. Consequently, if cold water is allowed to enter into the hot water pipe 50H, the water within the hot water pipe 50H will be cooled and can no longer be relied upon by the user to be consistently hot. Accordingly, the ability to maintain the preferred water temperature is lost due to the inconsistent temperature of the hot water.

The present invention solves these problems by providing the check valves 24C and 24H. For example, when water in the mixing chamber 32 moves toward the cold water chamber 14C, the pressure of the water will cause the check valve 24C to sit down and seal the inlet hole 34C. Likewise, when water in the mixing chamber 32 moves toward the hot water chamber 14H, the pressure of the water will cause the check valve 24H to sit down and seal the inlet hole 34H. Accordingly, backflow into either the cold water pipe 50C or the hot water pipe 50H is prevented.

Figure 5:
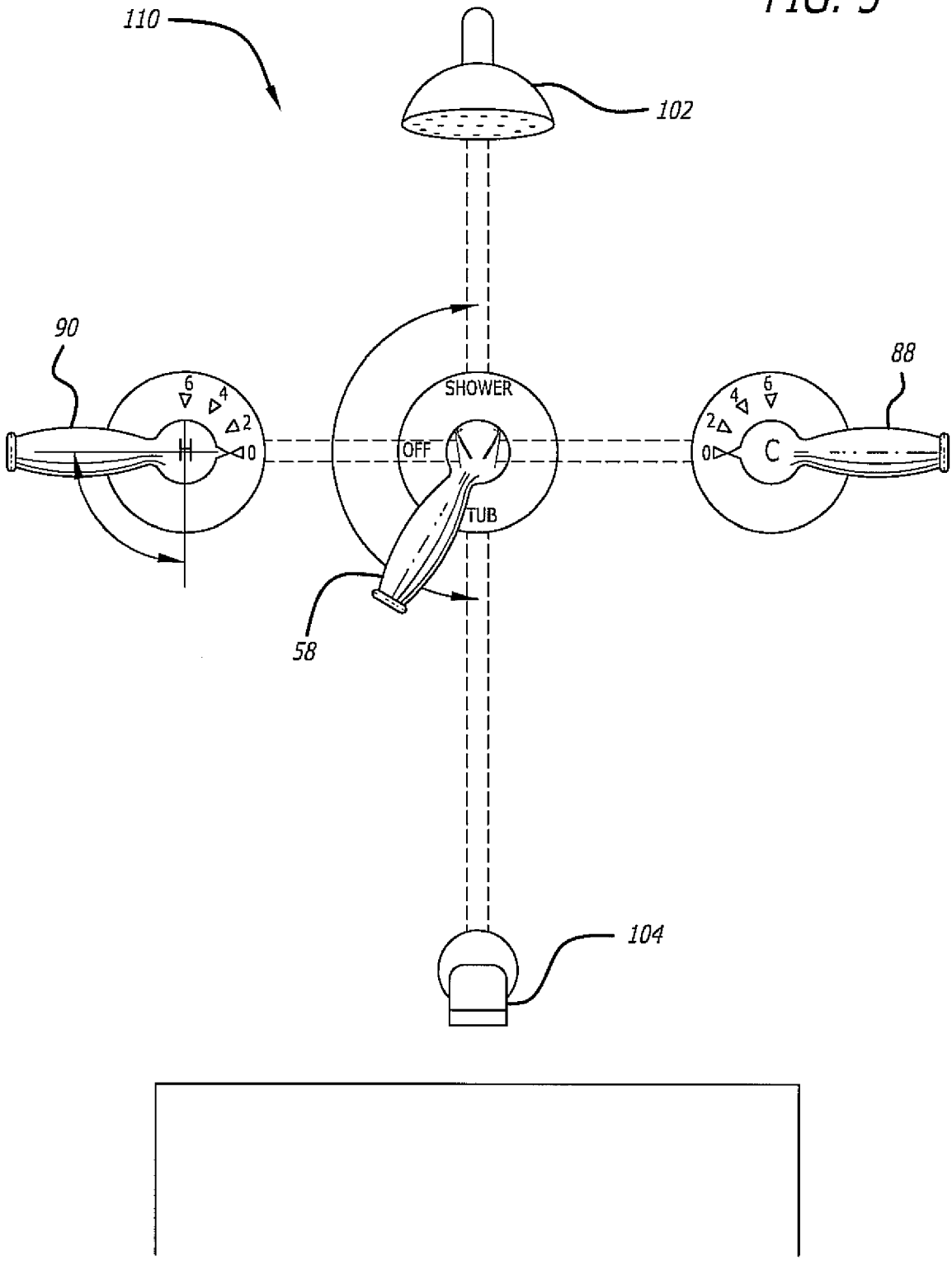
FIG. 5 illustrates a shower faucet having a water temperature retaining feature in accordance with one embodiment of the present invention.

FIG. 5 illustrates a shower faucet having a water temperature retaining feature in accordance with one embodiment of the present invention. Referring to FIG. 5, the shower faucet 110 comprises a hot water handle 90 for controlling the flow of hot water and a cold water handle 88 for controlling the flow of cold water through the shower faucet 110. When the hot water handle 90 is in a closed position, no hot water flows through the shower faucet 110. Likewise, when the cold water handle 88 is in a closed position, no cold water flows through the shower faucet 110. When the hot water handle 90 is manipulated into an open position, hot water from a hot water reservoir is allowed to flow through the shower faucet 110. Moreover, when the cold water handle 88 is manipulated into an open position, cold water from a cold water reservoir is allowed to flow through the shower faucet 110. Preferably the hot water mixes with the cold water within the shower faucet 110 prior to being dispensed out of either a shower dispenser 102 or a tub dispenser 104. Here, a master handle 58 may be manipulated by the user to dispense the mixed water through either the shower dispenser 102 or the tub dispenser 104 according to the user's preference. Furthermore, the hot and cold water handles are preferably manipulated by the user such that a preferred mixed water temperature and a maximum volume of water flow are achieved according to the user's preference. Also, an exterior of the water faucet preferably comprises markings for use with the hot and cold water handles in order for the user to respectively measure the amount of hot and cold water capable of flowing through the water faucet.

In accordance with the present invention, the master handle 58 for controlling the dispensing of mixed water through the shower dispenser 102 or the tub dispenser 104 may also be used to shut off the flow of water. Accordingly, while the hot water handle 90 and the cold water handle 88 remain in the open position, mixed water flow through the shower dispenser 102 or the tub dispenser 104 may be stopped by manipulating the master handle 58 into a closed position. Thus, when the user achieves the preferred water temperature by successfully manipulating the hot water handle 90 and the cold water handle 88 to achieve a preferred ratio of hot and cold water, the user may use the master handle 58 to shut off water flow without having to close off the hot and cold water handles. This greatly conveniences the user the next time he/she wishes to use the shower faucet 110 because the user does not have to re-manipulate the hot and cold water handles to attain the preferred ratio of hot and cold water. Therefore, by leaving the hot and cold water handles in the position they were in prior to shutting off the master handle 58, the preferred mix of hot and cold water will be duplicated when turning on the master handle 58 at a later point in time. In addition, the volume of water flow can be adjusted up or down at any time by manipulating the master handle 58 without affecting the preferred ratio of hot and cold water, which was preset by the hot water handle 90 and the cold water handle 88.

Figure 6:
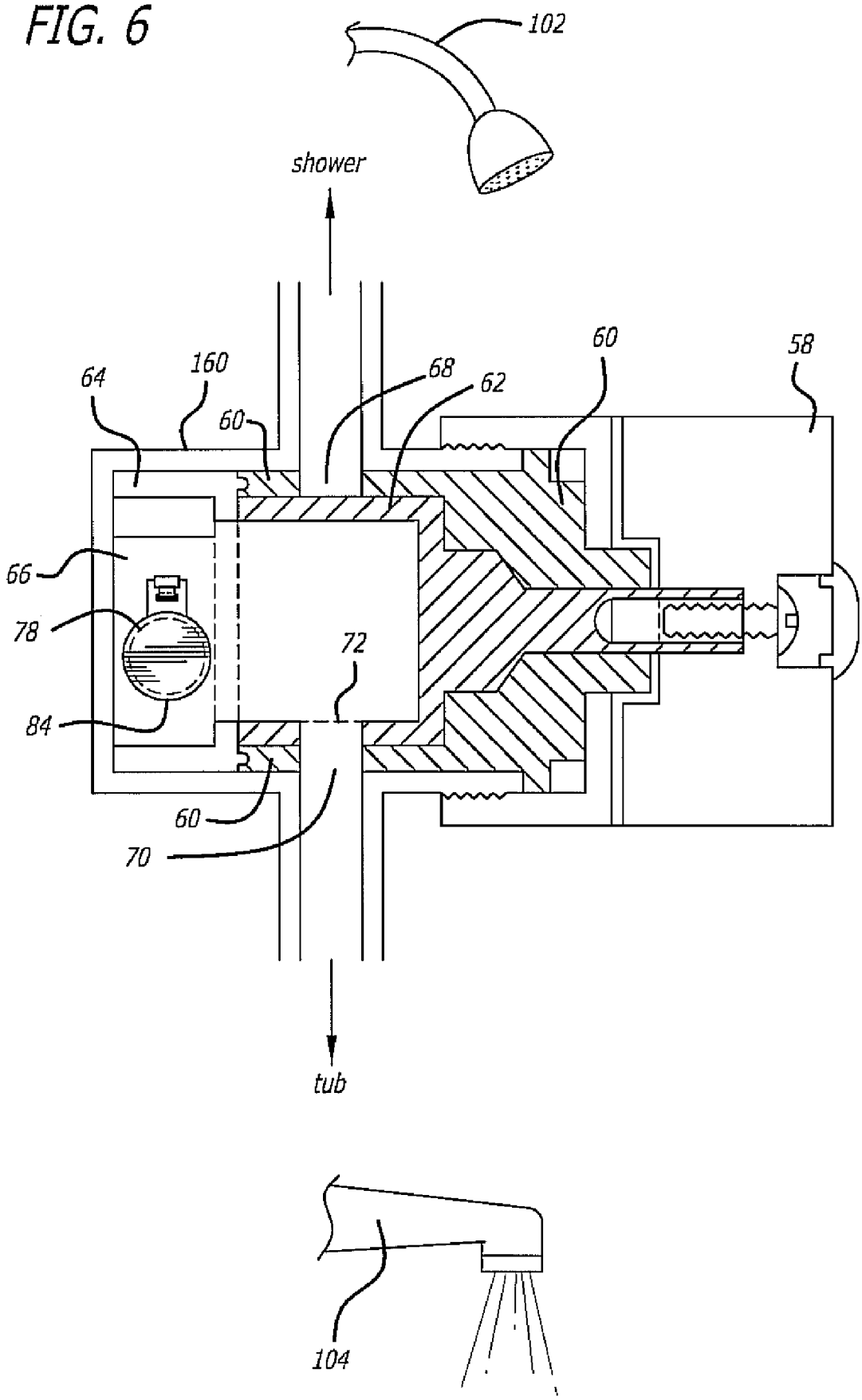
FIG. 6 illustrates an internal structure of a shower faucet having a water temperature retaining feature in accordance with one embodiment of the present invention.
Figure 7A:
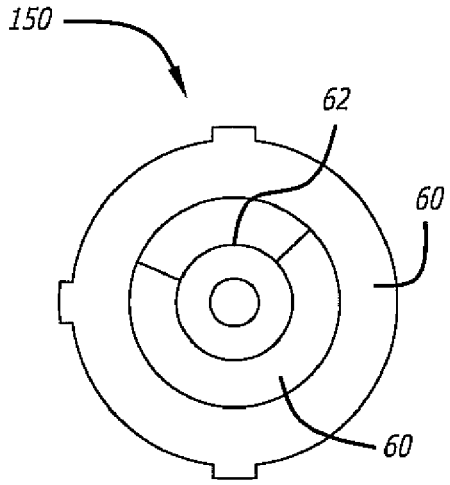
FIG. 7A illustrates a top elevational view of a flow control cartridge for use in a shower faucet in accordance with one embodiment of the present invention.
Figure 7B:
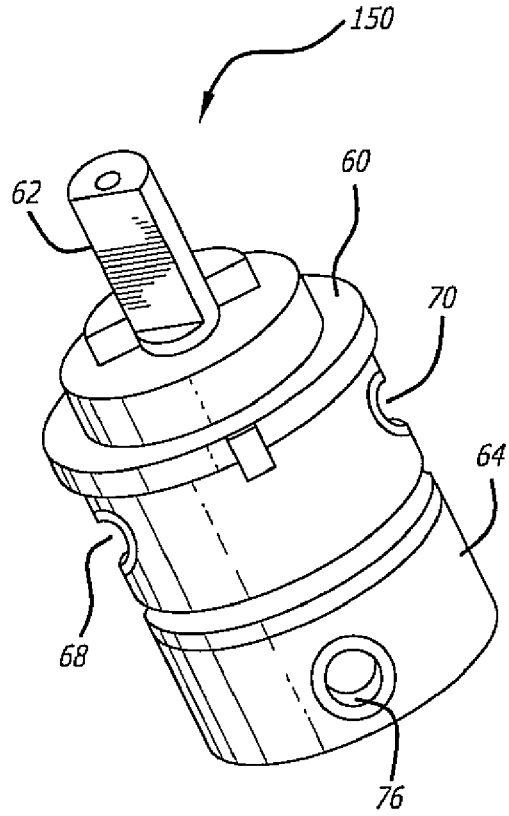
FIG. 7B illustrates a first side view of a flow control cartridge for use in a shower faucet in accordance with one embodiment of the present invention.
Figure 7C:
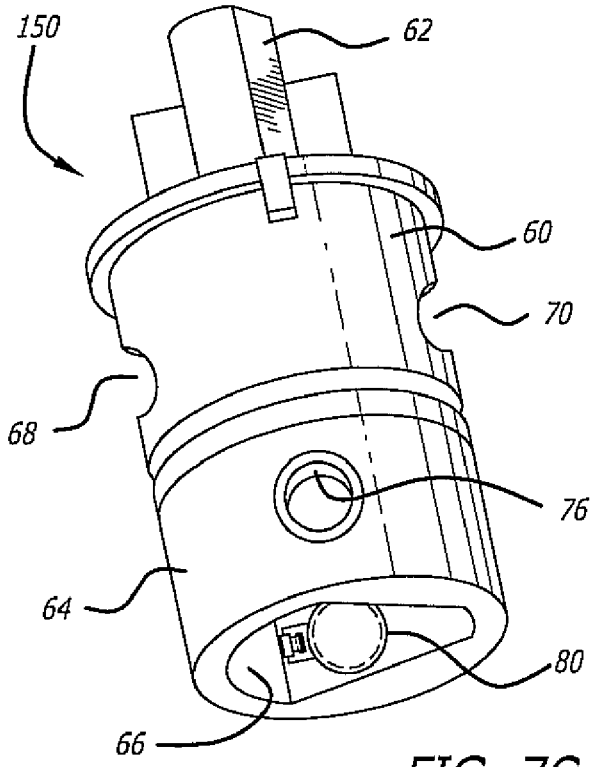
FIG. 7C illustrates a second side view of a flow control cartridge for use in a shower faucet in accordance with one embodiment of the present invention.
Figure 7D:
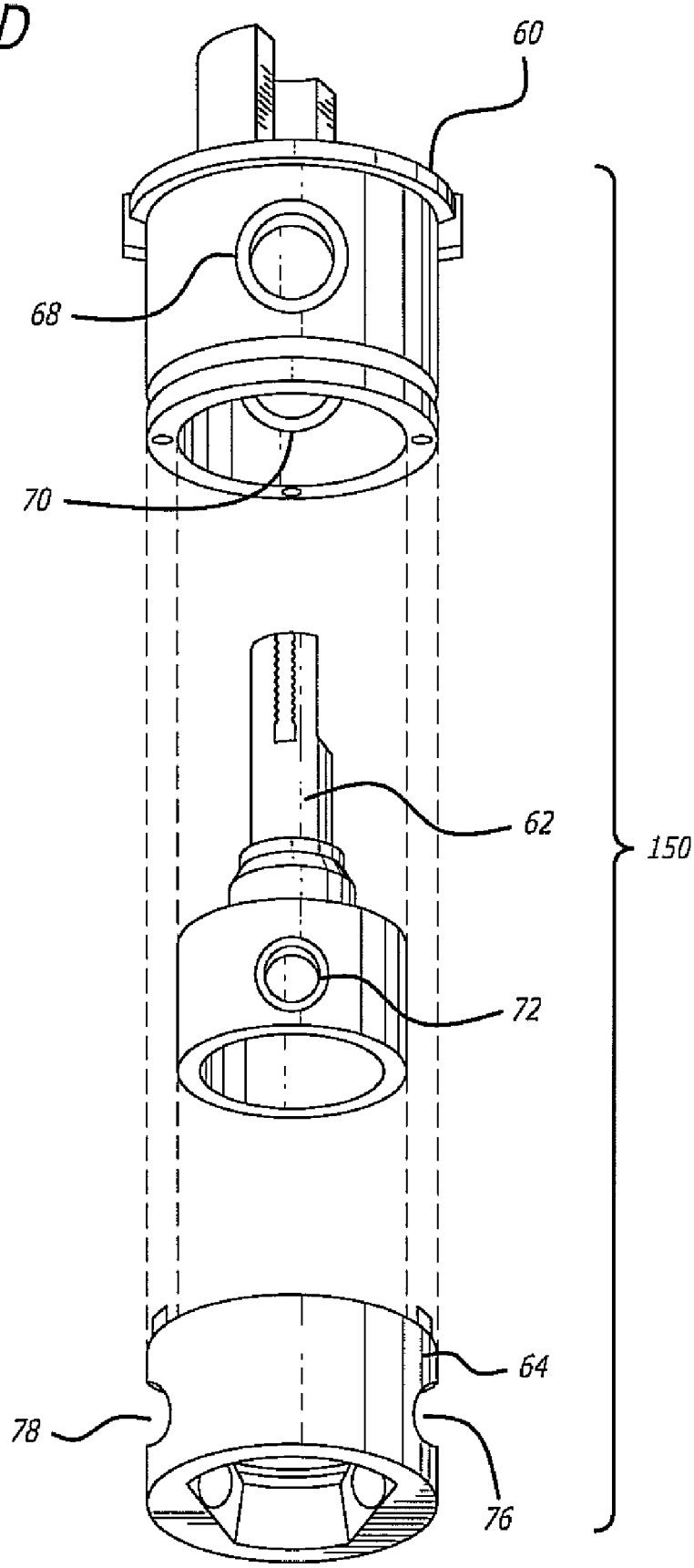
FIG. 7D illustrates an exploded view of a flow control cartridge for use in a shower faucet in accordance with one embodiment of the present invention.

FIG. 6 illustrates an internal structure of a shower faucet having a water temperature retaining feature in accordance with one embodiment of the present invention. FIGS. 7A-7C illustrate multiple views of a flow control cartridge for use in a shower faucet in accordance with one embodiment of the present invention. FIG. 7D illustrates an exploded view of a flow control cartridge for use in a shower faucet in accordance with one embodiment of the present invention. Referring to FIGS. 6 and 7A-7D, a faucet housing 160 houses a flow control cartridge 150 for regulating the flow of hot and cold water through the shower faucet 110. Preferably, the faucet housing 160 may be an interior of a bathroom wall, for example. As shown, the flow control cartridge 150 comprises a base cartridge 64, an inner cartridge 62 and an outer cartridge 60.

The base cartridge 64 comprises a hot water inlet 76 for receiving hot water from a hot water supply and a cold water inlet 78 for receiving cold water from a cold water supply. Preferably, an interior of the base cartridge 64 comprises a mixing chamber 66 for allowing the hot and cold water to mix together. The outer cartridge 60 is engaged with the base cartridge 64 and comprises a shower outlet 68 for directing water toward the shower dispenser 102 and a tub outlet 70 for directing water toward the tub dispenser 104. Preferably, an interior of the outer cartridge 60 is hollow and is able to accept water flowing from the mixing chamber 66. Furthermore, the base cartridge 64 and the outer cartridge 60 are fixed to each other such that a lateral and longitudinal position of the flow control cartridge 150 is retained within the faucet housing 160.

The inner cartridge 62 is rotatably coupled to an inner circumference of the outer cartridge 60 such that it can axially rotate relative to the outer cartridge 60. The inner cartridge 62 comprises a diverting outlet 72 for diverting water either to the shower outlet 68 or the tub outlet 70. A protruding portion of the inner cartridge 62 protruding out of the outer cartridge 60 is attached to the master handle 58. Preferably, the protruding portion of the inner cartridge 62 is threaded, such that the master handle 58 may be screwed into the inner cartridge 62. Preferably, an interior of the inner cartridge 62 is hollow and is able to accept water flowing from the mixing chamber 66. Furthermore, the water accepted by the inner cartridge 62 may be diverted to either the shower dispenser 102 or tub dispenser 104 when the diverting outlet 72 is rotatably aligned with either the shower outlet 68 or tub outlet 70 of the outer cartridge 60.

In operation, when the hot water handle 90 is turned to the closed position, no hot water enters into the mixing chamber 66 through the hot water inlet 76. Likewise, when the cold water handle 88 is turned to the closed position, no cold water enters into the mixing chamber 66 through the cold water inlet 78. However, when the hot water handle 90 and the cold water handle 88 are turned to the open position, hot and cold water may respectively enter through the hot water inlet 76 and the cold water inlet 78 of the base cartridge 64 to mix within the mixing chamber 66. Preferably, present invention is designed such that the more the hot water handle 90 and the cold water handle 88 are turned to the open position, the more hot and cold water will respectively flow through the hot water inlet 76 and cold water inlet 78 and into the mixing chamber 66.

Preferably, the hot and cold water combine in the mixing chamber 66 prior to flowing into the combined structure of the outer cartridge 60 and the inner cartridge 62. However, the hot and cold water may also mix within the interior of the outer cartridge 60 and the inner cartridge 62. Afterward, according to a user's preference, the mixture of hot and cold water may be dispensed through the shower dispenser 102 or the tub dispenser 104. In order to dispense the water through the shower dispenser 102, the user manipulates the master handle 58 to rotate the inner cartridge 62 such that the diverting outlet 72 of the inner cartridge 62 is aligned with the shower outlet 68 of the outer cartridge 60. Accordingly, the water is diverted toward the shower dispenser 102. Alternatively, in order to dispense the water through the tub dispenser 104, the user manipulates the master handle 58 to rotate the inner cartridge such that the diverting outlet 72 of the inner cartridge 62 is aligned with the tub outlet 70 of the outer cartridge 60. Accordingly, the water is diverted toward the tub dispenser 104.

According to the user's preference, the hot water handle 90 and the cold water handle 88 may be manipulated until a preferred ratio of hot and cold water is attained. Once the preferred ratio is achieved, the hot and cold water handles may be left in their respective positions. When the user wishes to shut off water flow, the user may manipulate the master handle 58 to cease dispensing of the water. For example, the user may turn the master handle 58 such that the diverting outlet 72 of the inner cartridge 62 is not aligned with either the shower outlet 68 or the tub outlet 70 of the outer cartridge 60. Accordingly, by using the master handle 58 to shut off water flow, the hot water handle 90 and the cold water handle 88 remain in the same respective positions they were in prior to shut off. Thus, when the user wishes to resume water flow at the preferred ratio of hot and cold water, the user may simply manipulate the master handle 58 to re-dispense water through the shower outlet 68 or the tub outlet 70 without having to re-manipulate the hot and cold water handles.

Consequently, by being able to resume water flow without having to re-manipulate the hot and cold water handles, water is conserved. For example, a maximum volume of water flow can be preset at the same time as the preferred water temperature using the hot and cold water handles. Accordingly, when the master handle 58 is manipulated to resume water flow, only the maximum preset volume of water will flow through the shower outlet 68 or the tub outlet 70. This is advantageous with certain users, such as children, who may irresponsibly manipulate hot and cold water handles of a typical faucet without regard to water conservation. Hence, by utilizing the shower faucet of the present invention, users are able to easily conserve water without undue burden.

FIGS. 8A and 8B illustrate views of a flow control cartridge having check valves in accordance with one embodiment of the present invention. Referring to FIGS. 6, 7A-7D and 8A-8B, check valves 84, 80 are disposed on the interior of the base cartridge 64 for movably sealing the hot water inlet 76 and cold water inlet 78, respectively. Preferably, a portion of the check valve 84 is coupled to the interior of the base cartridge 64 via a check valve hook 82H, and a portion of the check valve 80 is coupled to the interior of the base cartridge 64 via a check valve hook 82C. Here, the check valve hooks allow the check valves to open and close upon the hot water inlet 76 and cold water inlet 78, respectively.

In operation, when the cold water handle 88 is turned to the open position, pressure from the cold water flowing from the cold water supply toward the flow control cartridge 150 causes the check valve 80 to lift up at one side, thus allowing the cold water to flow through the cold water inlet 78 and into the mixing chamber 66. Likewise, when the hot water handle 90 is turned to the open position, pressure from the hot water flowing from the hot water supply toward the flow control cartridge 150 causes the check valve 84 to lift up at one side, thus allowing the hot water to flow through the hot water inlet 76 and into the mixing chamber 66.

However, when the user wishes to shut off water flow using the master handle 58 while the hot and cold water handles remain in the open position, a pressure difference between the hot and cold water in the mixing chamber 66 may cause backflow to occur. For instance, if the pressure of hot water in the mixing chamber 66 is greater than the pressure of the cold water, then the water in the mixing chamber 66 will move toward the cold water inlet 78 and back into a pipe carrying the cold water from the cold water supply. Alternatively, if the pressure of cold water in the mixing chamber 66 is greater than the pressure of the hot water, then the water in the mixing chamber 66 will move toward the hot water inlet 76 and back into a pipe carrying the hot water from the hot water supply.

The present invention solves these problems by providing the check valves 80, 84. For example, when water in the mixing chamber 66 moves toward the cold water inlet 78, the pressure of the water will cause the check valve 80 to close and seal the cold water inlet 78. Likewise, when water in the mixing chamber 66 moves toward the hot water inlet 76, the pressure of the water will cause the check valve 84 to close and seal the hot water inlet 76. Accordingly, backflow into either of the pipes carrying water from its water supply is prevented.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. A water faucet having a water temperature retaining feature, the water faucet comprising:

a hot water control for controlling an amount of hot water flowing through the water faucet, wherein the hot water control allows hot water from a hot water supply to flow through the water faucet when the hot water control is in an open position;

a cold water control for controlling an amount of cold water flowing through the water faucet, wherein the cold water control allows cold water from a cold water supply to flow through the water faucet when the cold water control is in an open position;

a mixing chamber for receiving the hot water from the hot water supply and the cold water from the cold water supply;

a first flow control cartridge operationally coupled with the hot water control for regulating the flow of hot water from the hot water supply into the mixing chamber, the first control cartridge comprising an outer cartridge for retaining a fixed position of the first flow control cartridge within the hot water chamber and an inner cartridge rotatably fixed to the hot water control and rotatably coupled to an inner circumference of the outer cartridge, the inner cartridge of the first flow control cartridge comprising a stopper for regulating the flow of hot water from the hot water pipe into the hot water chamber, and the stopper of the first flow control cartridge comprising an inlet hole for operating with a chamber hole of the hot water chamber to regulate hot water flow;

a second flow control cartridge operationally coupled with the cold water control for regulating the flow cold water from the cold water supply into the mixing chamber, the second control cartridge comprising an outer cartridge for retaining a fixed position of the second flow control cartridge within the cold water chamber and an inner cartridge rotatably fixed to the cold water control and rotatably coupled to an inner circumference of the outer cartridge, the inner cartridge of the second flow control cartridge comprising a stopper for regulating the flow of cold water from the cold water pipe into the cold water chamber, and the stopper of the second flow control cartridge comprising an inlet hole for operating with a chamber hole of the cold water chamber to regulate cold water flow;

an outlet connected to the mixing chamber for dispensing a mixture of hot and cold water received from the mixing chamber;

a master control for controlling the dispensing of water through the outlet, wherein the master control is capable of stopping the dispensing of water through the outlet while either of the hot water control and the cold water control is in the open position;

a hot water pipe for connecting to the hot water supply;

a hot water chamber connected between the hot water pipe and the mixing chamber, wherein the hot water chamber houses the first flow control cartridge;

a cold water pipe for connecting to the cold water supply;

a cold water chamber connected between the cold water pipe and the mixing chamber, wherein the cold water chamber houses the second flow control cartridge;

a first check valve disposed on the stopper of the first flow control cartridge for movably sealing the inlet hole of the first flow control cartridge to prevent backflow of water into the hot water pipe; and a second check valve disposed on the stopper of the second flow control cartridge for movably sealing the inlet hole of the second flow control cartridge to prevent backflow of water into the cold water pipe.

2. The water faucet of claim 1, wherein:

the amount of hot water flowing into the mixing chamber via the hot water chamber is dependent on a position of the inlet hole of the first flow control cartridge relative to the chamber hole of the hot water chamber; and the amount of cold water flowing into the mixing chamber via the cold water chamber is dependent on a position of the inlet hole of the second flow control cartridge relative to the chamber hole of the cold water chamber.

3. The water faucet of claim 2, wherein:

the position of the inlet hole of the first flow control cartridge relative to the chamber hole of the hot water chamber is controlled by the rotational movement of the inner cartridge via the hot water control; and the position of the inlet hole of the second flow control cartridge relative to the chamber hole of the cold water chamber is controlled by the rotational movement of the inner cartridge via the cold water control.

4. The water faucet of claim 1, wherein an exterior of the water faucet comprises markings for use with the hot and cold water controls to respectively measure the amount of hot and cold water capable of flowing through the water faucet.

5. The water faucet of claim 1, wherein the master control is manipulated to seal the outlet when stopping the dispensing of water through the outlet while either of the hot water control and the cold water control is in the open position.

6. A water faucet having a water temperature retaining feature, the water faucet comprising:

a hot water control for controlling an amount of hot water flowing through the water faucet, wherein the hot water control allows hot water from a hot water supply to flow through the water faucet when the hot water control is in an open position;

a cold water control for controlling an amount of cold water flowing through the water faucet, wherein the cold water control allows cold water from a cold water supply to flow through the water faucet when the cold water control is in an open position;

a flow control cartridge operationally connected to the hot water supply and cold water supply for regulating the flow of hot and cold water through the water faucet, the flow control cartridge comprising:

a base cartridge for receiving hot and cold water, the base cartridge comprising a hot water inlet for receiving hot water from a hot water supply and a cold water inlet for receiving cold water from a cold water supply;

an outer cartridge connected to the base cartridge, wherein the outer cartridge is capable of directing water received via the base cartridge toward the shower dispenser and the tub dispenser; and an inner cartridge rotatably disposed within an inner circumference of the outer cartridge for controlling which of the shower dispenser and the tub dispenser to dispense water through;

a shower dispenser connected to the flow control cartridge for dispensing a mixture of hot and cold water received via the flow control cartridge;

a tub dispenser connected to the flow control cartridge for dispensing a mixture of hot and cold water received via the flow control cartridge;

a master control operationally connected to the flow control cartridge for controlling the dispensing of water through the shower dispenser and the tub dispenser, wherein the master control is capable of stopping the dispensing of water through the shower dispenser and the tub dispenser while either of the hot water control and the cold water control is in the open position;

a first check valve disposed on an interior of the base cartridge for movably sealing the hot water inlet to prevent backflow of water into the hot water supply; and a second check valve disposed on an interior of the base cartridge for movably sealing the cold water inlet to prevent backflow of water into the cold water supply.

7. The water faucet of claim 6, wherein an interior of the base cartridge comprises a mixing chamber for mixing the received hot and cold water.

8. The water faucet of claim 6, wherein the outer cartridge comprises:

a shower outlet for directing water toward the shower dispenser; and a tub outlet for directing water toward the tub dispenser.

9. The water faucet of claim 8, wherein the inner cartridge comprises a diverting outlet for controlling which of the shower dispenser and the tub dispenser to dispense water through, wherein the diverting outlet directs water toward the shower dispenser when rotatably aligned with the shower outlet of the outer cartridge and directs water toward the tub dispenser when rotatably aligned with the tub outlet of the outer cartridge.

10. The water faucet of claim 9, wherein alignment of the diverting outlet to either of the shower outlet and tub outlet is rotatably controlled by the master control operationally connected to a protruding portion of the inner cartridge.

11. The water faucet of claim 10, wherein the master control stops the dispensing of water through the shower dispenser and the tub dispenser while either of the hot water control and the cold water control is in the open position by rotating the inner cartridge such that the diverting outlet is not aligned with either of the shower outlet and tub outlet.

12. The water faucet of claim 6, wherein an exterior of the water faucet comprises markings for use with the hot and cold water controls to respectively measure the amount of hot and cold water capable of flowing through the water faucet.

* * * * *